US007844068B1

(12) United States Patent
Carver

(10) Patent No.: US 7,844,068 B1
(45) Date of Patent: Nov. 30, 2010

(54) WALL MOUNTED SPEAKER SYSTEM, APPARATUS AND METHOD

(75) Inventor: Robert W. Carver, Snohomish, WA (US)

(73) Assignee: Linear Corporation, Carlsbad, CA (US)

( * ) Notice: Subject to any disclaimer, the term of this patent is extended or adjusted under 35 U.S.C. 154(b) by 1313 days.

(21) Appl. No.: 11/325,881

(22) Filed: Jan. 4, 2006

Related U.S. Application Data

(60) Provisional application No. 60/642,189, filed on Jan. 5, 2005.

(51) Int. Cl.
*H04R 1/02* (2006.01)

(52) U.S. Cl. ..... 381/354; 381/152; 381/71.7; 267/136; 267/141.7

(58) Field of Classification Search ..... 381/71.1, 381/71.2, 71.7, 152, 372, 354, 182, 353; 267/136–141.7
See application file for complete search history.

(56) References Cited

U.S. PATENT DOCUMENTS 4,176,249 A * 11/1979 Inanaga et al. ..... 381/182
5,850,460 A * 12/1998 Tanaka et al. ..... 381/186
5,884,735 A * 3/1999 Eckel et al. ..... 188/378
6,373,956 B1 * 4/2002 Varla et al. ..... 381/353
2003/0123679 A1 * 7/2003 Dudleston et al. ..... 381/87

* cited by examiner

*Primary Examiner*—Vivian Chin
*Assistant Examiner*—Jason R Kurr
(74) *Attorney, Agent, or Firm*—DLA Piper LLP (US)

(57) ABSTRACT

A wall mounted speaker system which is arranged to alleviate problems of unwanted noise in the production and transmission of audio waves, particularly in the lower wave lengths from 20 to 200 hz. There is a speaker unit having a pair of vertically spaced speakers, and an inertial noise suppressing section positioned between the two speakers. The inertial noise suppressing section has an inertial mass which is moved in a back and forth motion to create an inertial offsetting force into a housing structure of the speaker section. The two speakers also create inertial forces which are also transmitted into the housing of the speaker unit, and these are substantially diminished by the interaction of the inertial forces of the speakers and those of the inertial noise suppressing system.

16 Claims, 8 Drawing Sheets

WALL MOUNTED SPEAKER SYSTEM, APPARATUS AND METHOD

RELATED APPLICATIONS

This application claims priority benefit of U.S. Ser. No. 60/642,189 filed Jan. 5, 2005.

BACKGROUND OF THE INVENTION a) Field of the Invention

The present invention relates to a wall mounted speaker system, with the associated apparatus and method, and more particularly to wall mounted speaker system which is arranged to alleviate problems of unwanted noise in the production and transmission of the audio waves.

b) Background Art

For a number of decades in the audio industry, audio amplifiers having greater acoustic power output have become increasingly popular, and accordingly the speakers which are designed to be driven by the amplifiers with higher power have also become more popular. Also, in more recent years, there has been another trend of instead of having the bulky high performance audio equipment located in a room, the speakers are mounted in wall cavities However, there have been problems in faithfully reproducing the music or other material that is being transmitted as an audio output because of the presence of unwanted noise resulting from vibrating movement of the wall structure to which the speak is mounted. The unwanted noise arises because the wall vibrates para-sympathetically relative to the speaker output.

This difficulty of suppressing unwanted noise is especially bothersome with the lower frequency waves that are emitted from a subwoofer (e.g. in wavelengths from 20 to 200 Hz). Accordingly, what has commonly happened is that the person who has the audio speakers mounted in the wall will simply "tune down" (i.e. suppress) the lower frequency portion of the sound waves. However, this is done at the sacrifice of a faithful reproduction of the music or other material being transmitted through the speaker.

It is toward these problems that the embodiments of the present invention are directed.

DESCRIPTION OF THE EMBODIMENTS OF THE INVENTION

Figure 1:
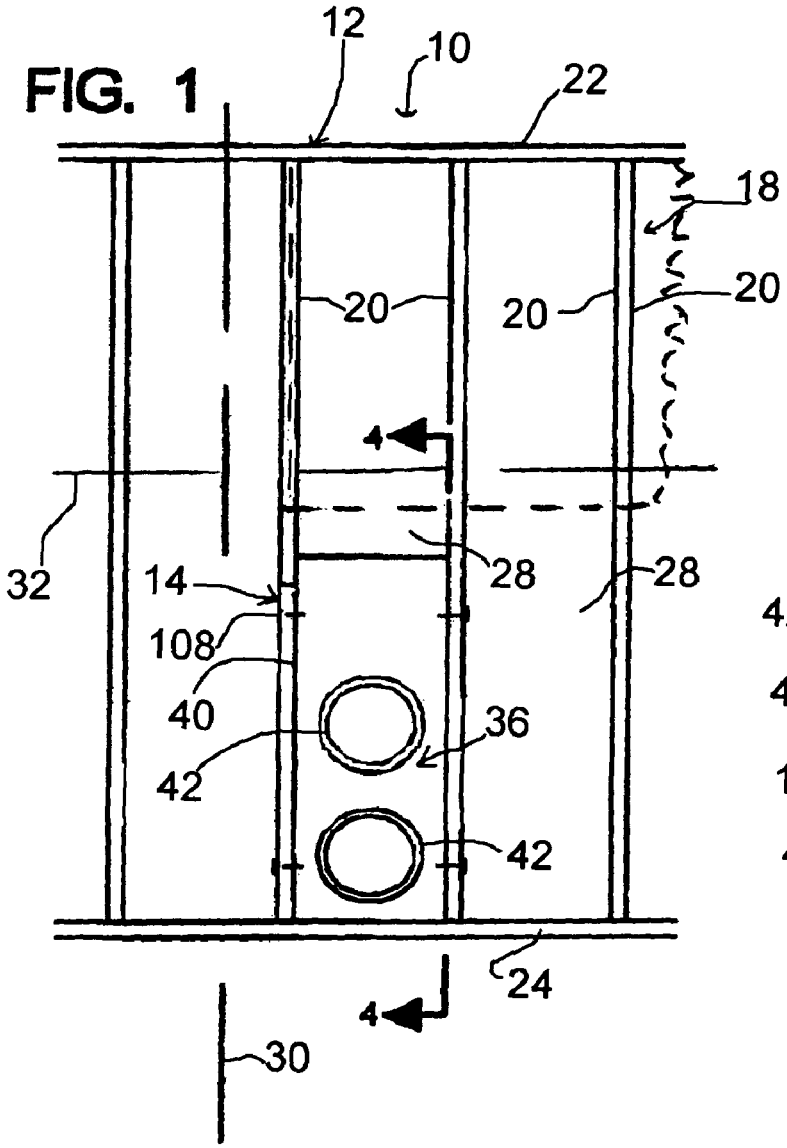
FIG. 1 is a front elevational view of a wall structure which has the front panels of the wall removed for purposes of illustration, and also showing a first embodiment of the speaker unit mounted in a spatial region of the wall structure.
Figure 2:
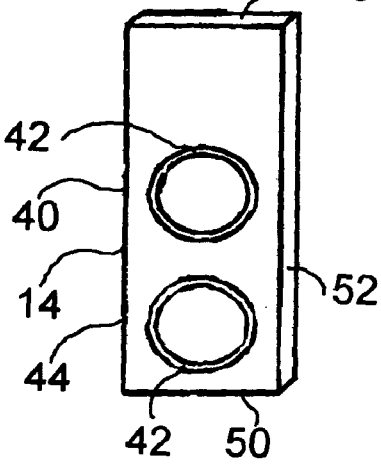
FIG. 2 is an isometric view of the speaker unit shown in front elevational view in FIG. 1.

Reference is first made to FIG. 1 where there is shown a first embodiment of the combination 10 of the present invention comprising a portion of a wall structure 12 and also a speaker assembly 14 mounted in the wall structure 12. In this embodiment the speaker assembly is provided as a unit, so for convenience of description, in the following text it will be referred to as the speaker unit 14.

The wall structure 12 of itself can be conventional and comprises a structural support section 18 and a panel section 20. The portion of the structural support section 18 shown in FIG. 1 comprises a plurality of vertically aligned studs 21 which are, or may be, wooden two-by-four's (i.e. wooden members having a rectangular cross section with width and thickness dimensions moderately less than four inches and two inches, respectively), and also upper and lower elongate horizontally aligned members which are also provided as wooden two-by-four's 22 and 24 respectively.

The aforementioned panel section 20, comprises a plurality of panels 26 which are (or may be) four foot by eight foot panels having a rectangular configuration and which connect to the structural support section 18. Such panels are commonly made of plasterboard but also could made from wood or other building materials, and a portion of one of the panels 26 is shown in FIG. 1 in broken lines.

Each adjacent pair of studs 20 along with the adjacent panel or panels 26, connecting to the studs 20, provide a plurality of spatial regions 28 defined by the laterally spaced pairs of studs 20, the front panel or panels, and also a rear panel or panels or possibly an outside wall that is connected on the opposite sides of the adjacent studs 20. As is common in the prior art, these spatial regions 28 can accommodate various building components, such as insulation, plumbing, wiring, etc.

Figure 4:
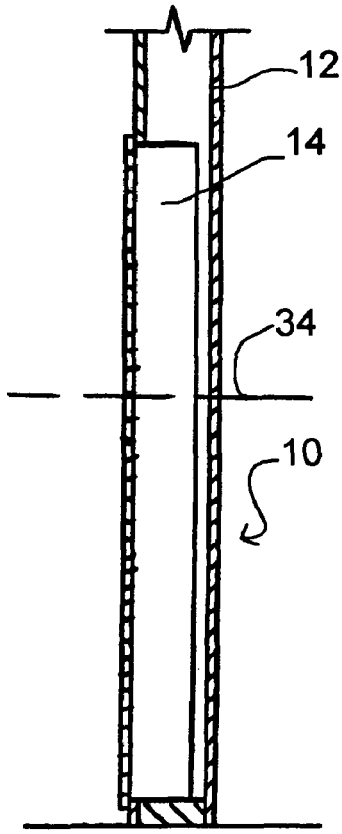
FIG. 4 is a sectional view of taken along line 4-4 of FIG. 1, showing the speaker unit mounted in a spatial region of the wall structure, and also showing a front protective grill mounted to the front surface of the wall immediately in front of the speaker unit.

For purposes of description, the wall structure 18 can be considered as having a vertical axis 30, a lateral axis 32 (see FIG. 1) extending horizontally along the wall structure, and a longitudinal axis 34 (see FIG. 4). The vertical and lateral axes 30 and 32, respectively, lie in a vertically aligned plane occupied by the wall structure 12, and the longitudinal axis 34 is a front to rear aligned axis that is perpendicular to the vertical and lateral axes 30 and 32 at their point of intersection.

In describing the components, positioning of the components and operation of the speaker unit 14, the orientation of these same axes 30, 32 and 34 will be used, and these axes 30, 32 and 34 will be deemed to be passing through the speaker unit 14 that is positioned in one of the spatial regions 28 of the wall structure 12.

As indicated above, it is to be understood that the wall structure 12 that is described above is, or may be, conventional, and this type of wall structure 12 is one that is commonly found in present day homes in the United States. The speaker unit 14 of the embodiments of the invention is structured so that it is arranged to be used in the wall structure 16 as described above. However, within the broader scope of the present invention, it could also be used in other wall structures 12 having characteristics which are such so that the wall structure with the speaker unit therein could benefit from the teachings of the present invention.

The speaker unit 14 comprises what can be termed the basic speaker section 36 and also an inertial noise suppressing section 38. The basic speaker section 36 is (or may be) of a conventional prior art design, but could have positioning and dimensional characteristics modified to optimize its use in connection with the inertial noise suppressing section 38.

The basic speaker section 36 comprises a speaker unit mounting structure 40 which in this embodiment comprises a speaker unit housing 40 with a pair of speakers 42 positioned in the speaker unit housing 40. The speaker unit housing 40 has in this embodiment a boxlike configuration (i.e. the configuration of a rectangular prism) comprising front and back walls 44 and 46, top and bottom walls 48 and 50, and two oppositely positioned side walls 52. These walls 44-52 collectively form a rigid structure to receive the inertial forces generated by the speaker section 36 and the inertial noise suppressing section 38. The front wall 44 has two circular cutouts at which the two speakers 42 are positioned.

In this embodiment, the two speakers 42 are, or may be, of conventional design, and also may be made as identical speakers 42. Since the basic design of such speakers 42 are well known in the prior art, these will not be described in any detail in the text.

In the following description of one of the two speakers 42, this will be done with the understanding that this description applies to both of the speakers 42.

Figure 5A:
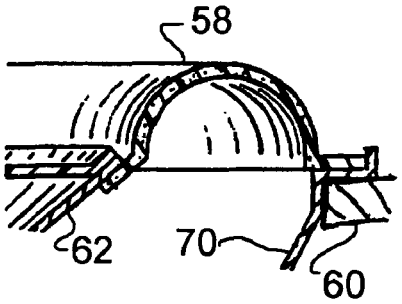
FIG. 5A is an isometric view drawn to an enlarged scale showing the surround by which the diaphragm/cone section is connected to stationary structure.
Figure 5:
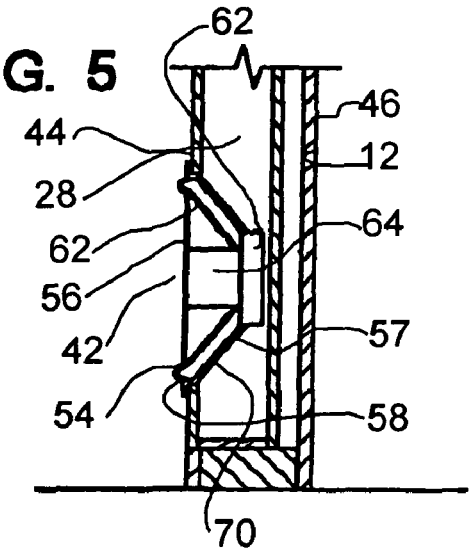
FIG. 5 is a somewhat schematic sectional view taken along line 5-5 of FIG. 1, illustrating one of the two speakers of the speaker unit.

Reference is first made to FIG. 5, which shows the lower speaker 42 positioned in the lower part of the spatial region 28 between the two adjacent studs 20. The speaker 42 comprises a moveable diaphragm section 54 which comprises a diaphragm 56 which in this embodiment comprises a relatively stiff circular diaphragm 56 and also a diaphragm mounting section 57. This mounting section 57 comprises a surround 58 which in turn connects between a perimeter of the diaphragm 56 and a circumferential edge portion 60 of the opening of the cylindrical opening formed in the front wall 44 to accommodate the speaker 42, and also a rearwardly positioned spider which is (or may be) of conventional design. The surround 58 can be seen more clearly in FIG. 5A.

The diaphragm section 54 also comprises a cone section 62 which, as its name implies, has a frusto-conical configuration, and this connects to a central member 64 which connects at its forward end to the diaphragm 56 and which extends rearwardly to connect to a cylindrical voice coil which is positioned within a stationary cylindrical speaker housing 68. The stationary housing 68 is shown as being connected to support struts 70 or other support that connects to the front wall 44 of the speaker unit housing 40. Additionally, the cylindrical speaker housing 68 may, if needed have additional support structure with the side walls 52 and/or the back wall 46.

There is positioned within the speaker housing 68 the stationary magnet section which is fixedly connected to the cylindrical speaker housing 68. There is a cylindrical voice coil mounted within the magnetic field of the magnet for reciprocating motion relative to the magnet, and the voice coil is connected to a rear suspension device such as a spider, which is part of the aforementioned diaphragm mounting section 52. The voice coil and the magnet comprise a drive section of each of the speakers 42. Since the voice coil and the magnet along with the related components are conventional and well known in the art, these are not illustrated in FIG. 5 nor described any further herein.

It is to be understood that this is one style of speaker 40 shown in the first embodiment, and there could, of course, be other types of speakers utilized.

As indicated above, the upper positioned speaker 42 has (or may have) the same configuration as the lower positioned speaker 42, and these two speakers 42 are spaced vertically from one another, so that the inertial noise suppressing section 38 can be positioned midway between the two speakers 42.

It is believed that the present invention will be understood if the description of the inertial noise suppressing section 38 is preceded by an explanation of the inertial forces resulting from operation of the two speakers 42.

In terms of function, each of the speakers 42 can be considered as having a fixed stationary portion and a moveable portion. The moveable portion of each speaker 42 comprises the diaphragm section 54 which includes the diaphragm 56 itself and the parts (as at 62) that are moveable therewith, and also approximately one half of the surround 58 and other suspension structure for the diaphragm section 54 which connect between the moveable and stationary portion. For example, it is common that the diaphragm section 54 would be mounted to stationary structure by the surround 58 and also the above mentioned spider, so that in terms of generating inertial forces, approximately half of the mass of the surround 58 and the spider would contribute to the inertial forces generated.

In addition the inertia of the mass of the air that is displaced in the back and forth movement of the cone/diaphragm section 54 products inertial forces which are part of the overall inertial forces generated during the back and forth movement of the diaphragm section 54. The air that is displaced has a certain amount of mass, and in both the forward and rearward motion of the diaphragm 54 a certain quantity of air is accelerated in one direction and then the other.

These inertial forces are generated when the voice coil is activated to move back and forth to create the low frequency sound waves.

Figure 3:
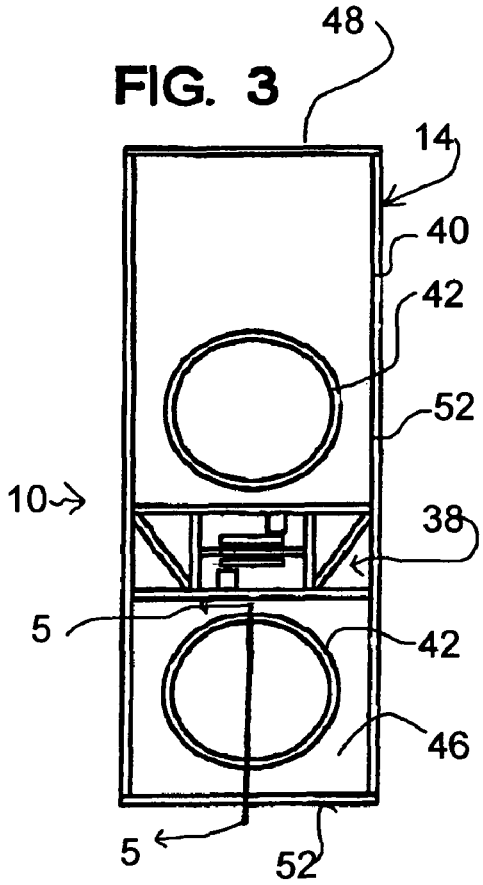
FIG. 3 is a front elevational view of the speaker unit of FIG. 2 with the front wall of the speaker housing being removed for purposes of illustration.

The function of the inertial noise suppressing section 38 is to alleviate the effect of these inertial forces in the manner to eliminate or at least substantially alleviate the unwanted noise that is generated in the operation of the speakers 42. The inertial noise suppressing section 38 is shown in FIG. 3 as being positioned between the upper and lower speakers 42, and for clarity is drawn to larger scale and shown in FIG. 6. Accordingly, reference will be made primarily to FIG. 6 in disclosing its operation.

As a general comment, each embodiment of the inertial noise suppressing section (designated 38 in this first embodiment) comprises an inertial mass and an electric power source to move the mass synchronously with the speakers 42. The power source of the inertial noise suppressing section 38 is driven by the same amplified audio signal that drives the two speakers 42. This is done in a manner that the tuning of the drive for the inertial mass is synchronized with the speakers 42 so that the phase, amplitude and frequency of the movement of the inertial mass or masses matches that of the two speakers 42.

Figure 6:
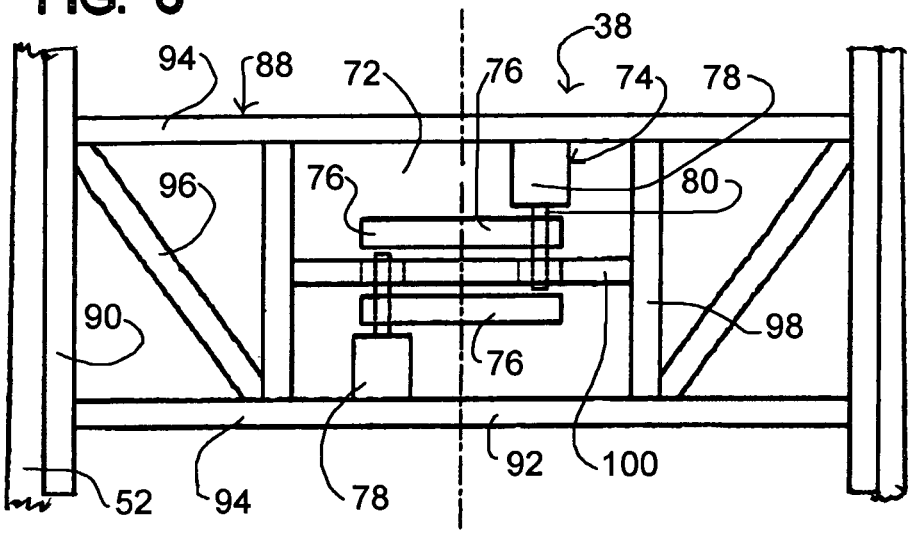
FIG. 6 is a view taken from the same location as in FIG. 3, drawn to an enlarged scale, and showing the inertial noise suppressing section of the first embodiment positioned in the speaker unit.

With further reference to the first embodiment of FIG. 6, there is an inertial section 72 and a power section 74. The inertial mass section 72 comprises two inertial members 76, with each inertial member 76 being moved in a back and forth arcuate movement by a related small electric motor 78, which comprises drive section or the power section 74. The two inertial masses 76 are (mainly for convenience) made in the shape of flat metal disks, and the two motors are small electric motors 78 such as those found in a hand held hair dryer that is used by a person to dry one's hair. The windings of the two motors 78 are (as indicated previously) powered by the same amplified signal as are the two speakers 42.

Figure 7A:
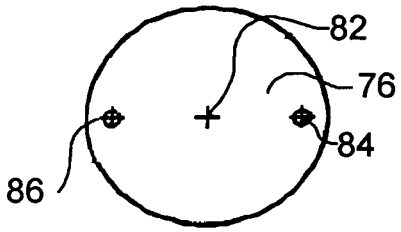
FIGS. 7A, 7B, and 7C are three sequential semi-schematic views showing the two inertial masses (disks) of a first embodiment in three different operating positions during an oscillating cycle.

Each motor 78 has a drive shaft 80 that connects to (and extends through) its related inertial disk 76 at a connecting location which is spaced radially outwardly from the center of the inertial disk 76. The geometric center of the disk 76 is indicated in FIG. 7A at 82, and this center is indicated in the form of a circle with a plus "+" sign without a circle. The two inertial disks are in their neutral positions spaced one above the other (as seen in FIG. 6) and also shown in the top plan view of FIG. 7A. The connecting locations to the drive shafts 80 (and hence the center of rotation for the two disks) is indicated at 84 and 86 and each is indicated by "+" in a circle near the perimeter of the disk 76. The connecting location of the shaft 80 to the lower disk 76 is also nearer the edge of that disk 76 but located diametrically opposite to the other connecting location 84. (In FIG. 7A for purpose of illustration the center of rotation 86 of the lower disk 76 shown. However since the disks 76 are vertically aligned with one another, the lower disk is not visible when the two disks are in a neutral mid location, but the center of rotation 86 is shown in Fib. 7A simply to indicate its location).

Figure 7B:
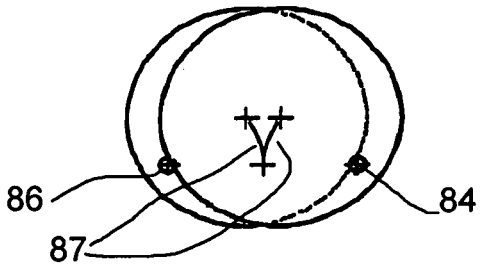
Figure 7C:
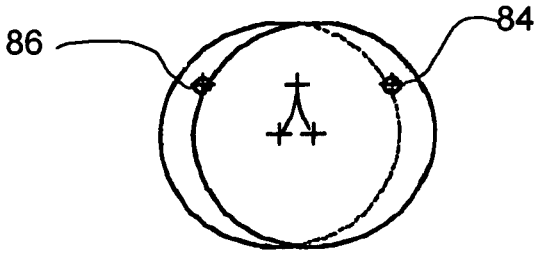

FIG. 7B shows the two inertial disks 76 having been rotated synchronously in a rearward direction so that the two centers of the disks 76 have been moved from the location of FIG. 7A to the location shown in FIG. 7B. The two paths of travel of the two centers 82 are illustrated by the two curved lines 87. It can be seen that the geometric centers of the two disks 76 have moved initially straight rearwardly and then curved in a moderate curved slant in a diverging relationship. The component of movement of the discs 76 in the same direction reinforces the inertial force generated by the two inertial disks 76, while the lateral component of movement away from one another cancel each other out. Thus, there is a net inertial force by the rearward movement of the two disks 82 which imposes forces on the drive shafts 80 of the two motors 78. Then the two discs 76 rotate in the opposite direction to the location at FIG. 7C.

With further reference to FIG. 6, there is shown somewhat schematically an inertial support structure in the form of a support frame 88 that has two end plates 90, each of which is fixedly connected to a related side wall 52 of the speaker unit housing 40. The central section 92 of the support frame 88 provides support for the two electric motors 78 and also for their drive shafts 80, support the inertial members in the form of the disks 76. There are upper and lower laterally extending support members 94 which provide a structural strength in a forward to rear direction, and these connect to, and extend between, two end plates 90 which are fixedly connected to the side walls 52. Diagonal bracing is provided as indicated at 96, and there are two vertical braces 98.

Extending between the two vertical braces 98 is a laterally extending center brace member 100 that extends between the upper and lower inertial disks 76 and connects to the outer end portions of the two shafts 80. Each shaft 80 has two spaced bearing support locations within its related motor 78, and there is also bearing support for each shaft 80 by the center brace member 100 so to alleviate possible bending moments created by the weight of the inertial disks 76 and other forces.

Each inertial disk 76 may be connected to its shaft by means of a spline connection along with a set screw or other device to maintain the disks in the proper connected location.

Figure 8:
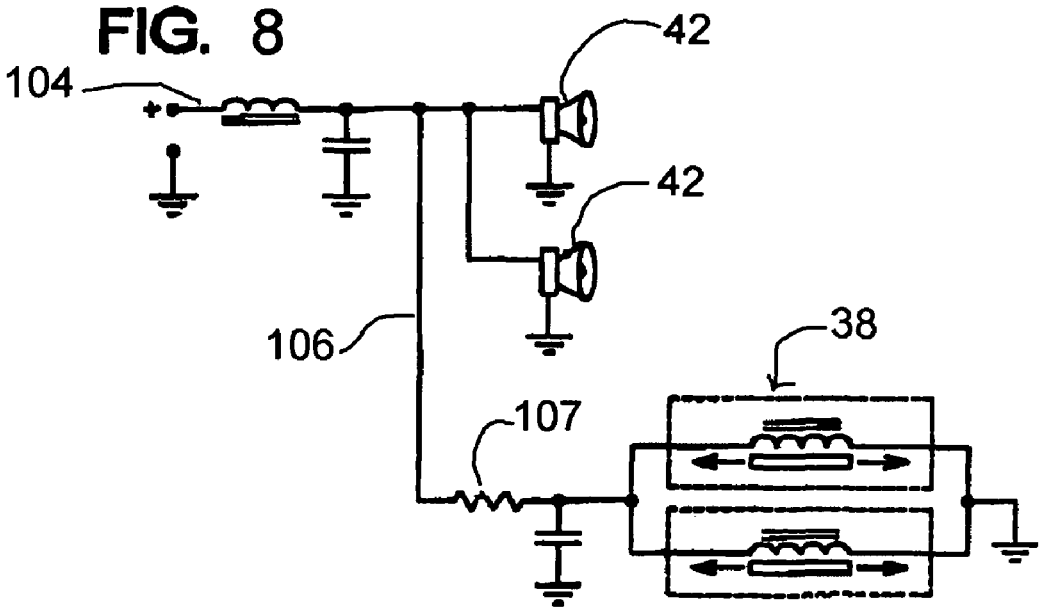
FIG. 8 is a schematic circuit diagram showing the power being directed from the amplified power signal to both the speakers and the inertial noise suppressing section.

Reference is now made to FIG. 8 which discloses schematically the power drive for both of the speakers 42 and also for the two motors 78. There is the input from the audio amplifier at the input location 104, and this input leads to both of these speakers 42. There is a cross over line 106 which leads through a variable resistor 107 to the power source for the inertial noise suppressing section 38. In this first embodiment, the two motors 78 comprise the power source, and these are simply indicated schematically by showing the coil section and the magnet section and the inertial mass. The connections in the two motors are made so that the inertial disks 76 will move synchronously with the back and forth motion in the two speakers 42. Thus, as the frequency and amplitude of the signal changes, the back and forth oscillations of the two disks 76 will change to match those of the two speakers.

With the foregoing being given, let us now review the installation and the operation of the speaker unit 14. As indicated previously, the speaker unit 14 comprises the speaker unit housing 40, the speaker section 36, and the inertial noise suppressing section 38.

The speaker unit housing 40 is made as a relatively stiff and strong structure, such as being made of three quarter inch medium or high strength fiberboard. The two speakers 42 and the inertial noise suppressing section 38 are preinstalled in the housing 40 so that the speaker unit 14 is a fully self contained unit that is delivered to the location of installation. The speaker unit 14 is placed between two two-by-four studs 20 desirably at a lower location, primarily for acoustic reasons. Then the speaker unit housing 40 is fixedly attached to the two studs 20 by means of suitable fasteners (such as bolts) to the two-by-four studs. The electrical connections to both the speakers 42 and the inertial noise suppressing section 38 are already made at the time of assembling the speaker unit 14, so it is necessary to make only external connections that are located at a convenient location on the speaker unit housing 40.

With the speaker unit 14 being securely mounted in the wall and connected to the adjacent two-by-four studs 20, the amplified audio signal is directed into the input 104 to drive both of the speakers 42 and also the inertial noise suppressing section 38. In this first embodiment, the inertial mass comprises the two inertial members 64 which are driven back and forth by the two electric motors 48. Thus, the electric input would be into the windings of the motor which interact with the magnetic field in the motor so as to move the output shaft rotationally in a back and forth movement along the center axis of the shaft 80. The back and forth inertial forces of the two inertial disks 76 is reacted into the inertial support frame 88 and into the speaker unit housing 40. As shown here, the inertial forces are directed in large part to the side walls 52, and these forces directed into the sidewall are in turn reacted into the rest of the rigid structure of the speaker unit housing 40.

At the same time, there are the inertial forces produced by the moveable portions of the two speakers 42 which as indicated previously comprises the diaphragm section 54 and the parts that are moveable therewith, one half of the surround 54 and other suspension structure for the cone/diaphragm 54, and also the inertial force of the air that is displaced. The inertial forces generated by the speakers 42 are reacted into the same housing 40 as are the inertial forces of the inertial noise suppressing section 38.

With the inertial force generating portion of the inertial noise suppressing section 38 being positioned in vertical alignment with the vertical centerline of the two speakers, and also mid-way between the two speakers 42, not only are the forward to rear force components cancelled, but these are also balanced so that there are no net force moments generated that could create "wobbling" force components.

Figure 9:
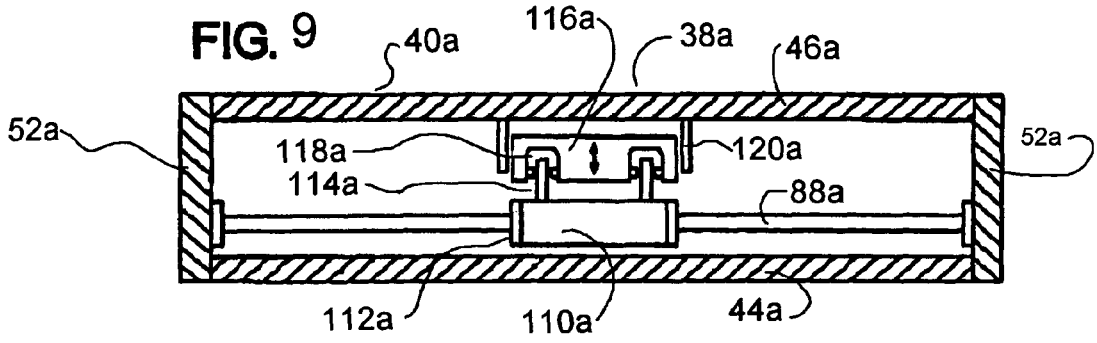
FIG. 9 is a sectional view taken along a horizontal plane extending through the speaker unit at a location slightly above the inertial noise suppressing section of a second embodiment of the invention.

In FIG. 9, there is shown a second embodiment of the present invention. In this second embodiment, components which are the same as, or similar to, components of the first embodiment will be given like numerical designations, with an "a" suffix distinguishing those of the second embodiment.

In this second embodiment, the speaker unit housing and the two speakers are, or may be, identical to (or substantially the same as) these corresponding numbered 40 and 42 components in the first embodiment. Accordingly, these are not shown in FIG. 9. However, the inertial noise suppression section 38*a* of the second embodiment differs from the inertial noise suppressing section 38 of the first embodiment. Accordingly, only this section 38*a* of the second embodiment is shown in FIG. 9.

There is shown in FIG. 9 a horizontal cross sectional view of the speaker unit housing 40*a* taken at the location of a horizontal plane above the inertial noise reducing section 38*a*. Thus, there are shown the front and rear walls 44*a* and 46*a* respectively, and the two side walls 52*a*. There is shown very schematically an inertial support frame 88*a*, with the understanding that this could have the various frame members, such as the laterally extending members, vertical bracing, etc., as needed, and as shown in FIG. 6.

The inertial noise suppressing section 38*a* comprises a stationary coil section 110*a* which has a base portion 112*a* supported from the inertial support frame 88*a*. The cylindrical coil members 114*a* extends rearwardly toward the rear wall 46*a*. There is a moving magnet section 116*a* which has cylindrical open region 118*a* which receives the cylindrical coil 114*a*. Guide members, which are shown schematically at 120*a* guide the moving magnet section as it is driven forwardly and rearwardly by the variable current in the coil section 114*a*.

Figure 10:
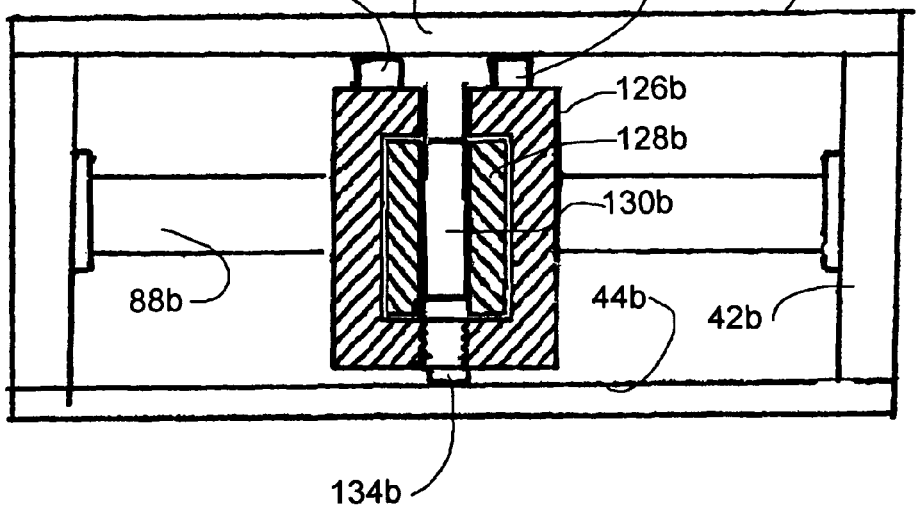
FIG. 10 is a view similar to FIG. 9, showing the inertial noise suppressing section of a third embodiment of the present invention.

A third embodiment of the present invention is shown in FIG. 10. Components of this third embodiment which are similar to components of the first two embodiments will be given like numerical designations, with a "b" distinguishing those of this third embodiment. As with the second embodiment of FIG. 9, the speaker unit housing and the two speakers are, or may be identical to (or substantially the same as) these components 40 and 42, respectively, in the first embodiment. Accordingly, these are not shown in FIG. 10. However, the inertial noise suppression section 38*b* of the third embodiment differs from the inertial noise suppressing section 38 of the first embodiment. Accordingly, only this section 38*b* of the third embodiment is shown in FIG. 10.

FIG. 10 is a view similar to that of FIG. 9, in that it is taken at a horizontal plane which extends through the speaker unit housing 40*b* at a location above the inertial noise suppressing section 38*b*. This inertial noise suppressing section 38*b* may have the overall configuration of a solenoid, where there is a housing 126*b* in which is positioned a coil section 128*b*, and a magnetic member 130*b* which is positioned for reciprocating motion in the cylindrical recess of the coil section 128*b*. Alternatively, there could be a reversal of parts, and the coil section 128 could have the center location, and the magnet 130*b* could be a surrounding magnet.

There is the laterally extending support frame 88*b* which connects to the housing 126*b* and at its outer ends connects to the side walls 52*b*. In addition, there are provided two front support members 132*b* connected to the front wall 44*b*. There is a rear threaded support member 134*b* which is threaded into a back part of the housing 126, and this could be rotated in a manner to have a snug engagement to both the front wall 44*b* and the back wall 46*b*.

A fourth embodiment of the present invention will now be described with reference to FIGS. 11 and 12. As with the second and third embodiments, the main difference of this fourth embodiment from the first embodiment is a different form of the noise suppressing section which in the description of this fourth embodiment is designated 38*c*. The speaker unit housing and the speakers are, or may be, very similar to or substantially the same as the speaker unit housing 40 and the speakers 42 of the first embodiment. Likewise, there is the inertial support frame which in construction and function can be substantially the same as the inertial support frame 88 which is shown in FIG. 6, and could also have the additional support members such as shown at 132*b* and 134*b* in FIG. 10. Accordingly, for ease of illustration, the speaker unit housing, the speakers, and also the support frame are not shown in FIG. 11. Rather, only the inertial force generating section of the inertial noise suppressing section 38*c* is shown.

Figure 12:
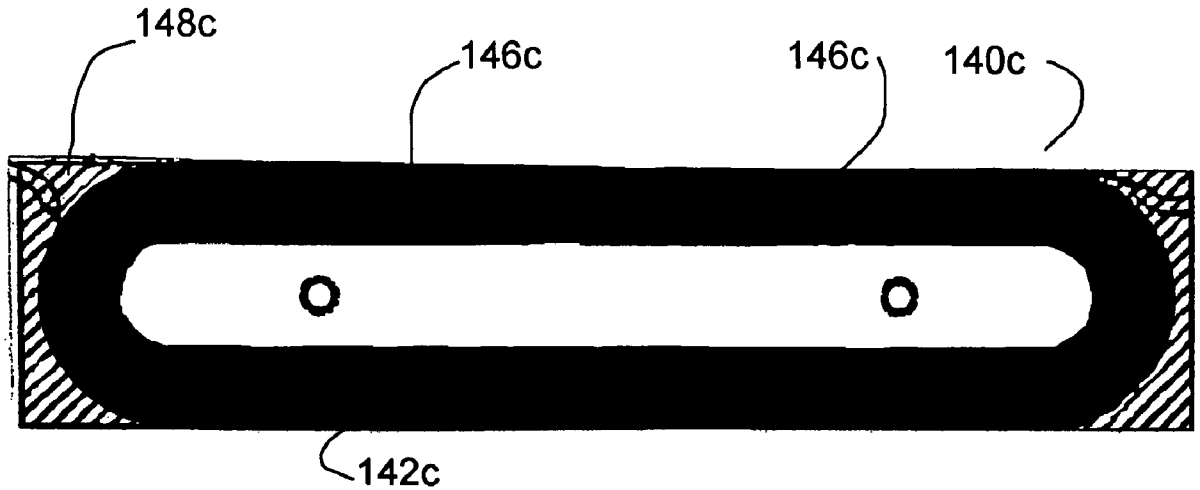
FIG. 12 is a planar view taking along line 12-12 of FIG. 11 showing the configuration of the voice coil of the inertial noise suppressing section in the fourth embodiment.
Figure 11:
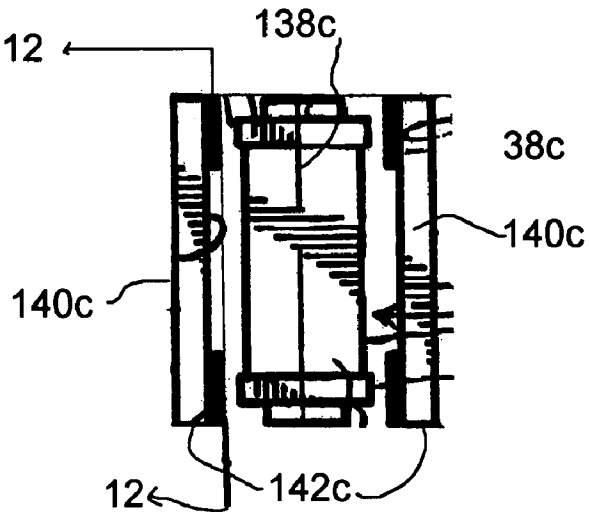
FIG. 11 is a view similar to both FIGS. 9 and 10, showing the inertial noise suppressing section of a fourth embodiment of the present invention.

With further reference to FIGS. 11 and 12 the inertial noise suppressing section 38*b* of this fourth embodiment of the present invention comprises a center magnet section 138*c* which is the inertial mass positioned between two identical coil portions 140*c* of a coil section 142*c*. One of the two coil sections 140*c* is shown in plan view in FIG. 12, where there is a wound coil 144*c* having two straight elongate central portions 146*c* and curved end portions 148*c*, providing a "race track" configuration. The magnet section 138*c* is positioned at the locations of the straight coil sections 146*c*, and is caused to oscillate in the direction of the arrow 150*c*.

Also, it is to be understood that the center magnet section 138*c* and the coil section 142*c* would be positioned within a suitable housing structure, and since this can be done in the manner shown somewhat schematically in the prior embodiments, this will not be described in this portion of the text describing the fourth embodiment.

Figure 13:
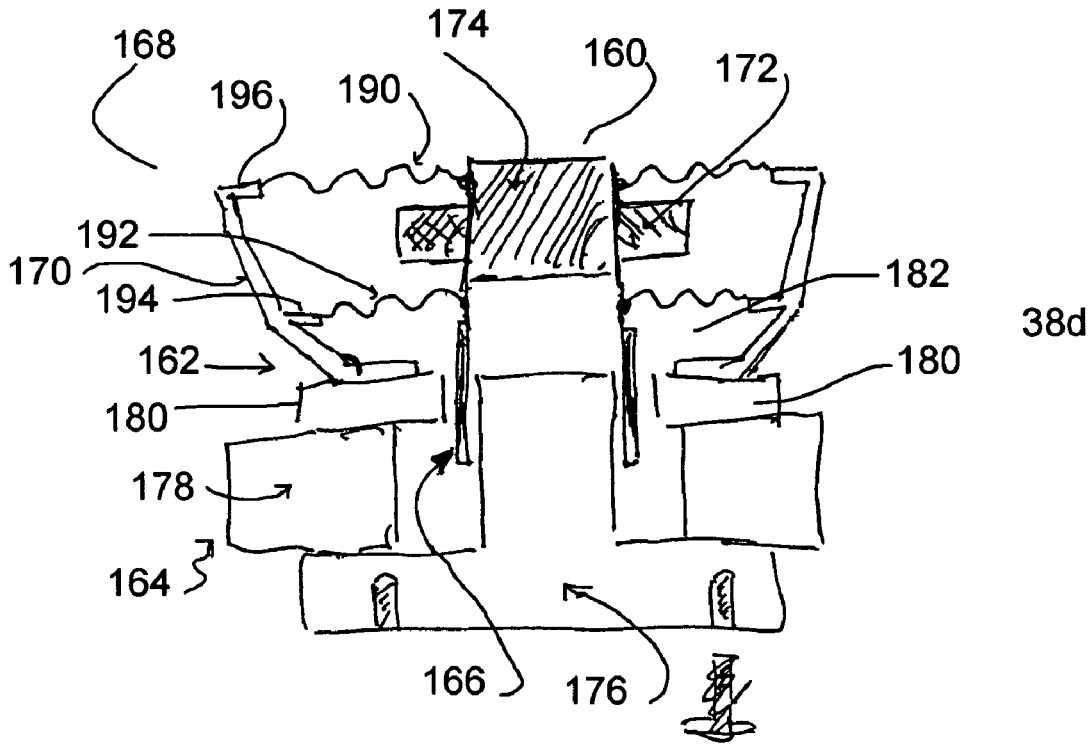
FIG. 13 is a sectional view of an inertial noise suppressing section of a fifth embodiment.
Figure 14A:
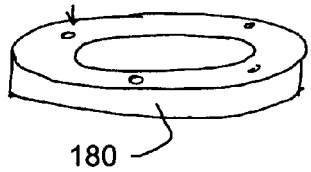
FIGS. 14A-14G show the operating components of the noise suppressing section of FIG. 13.
Figure 14D:
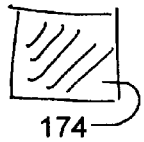
Figure 14B:
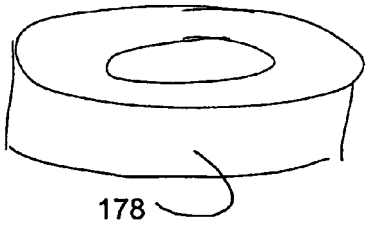
Figure 14E:
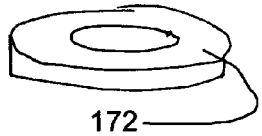
Figure 14F:
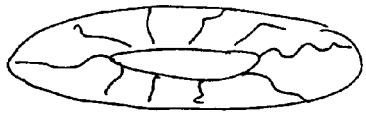
Figure 14C:
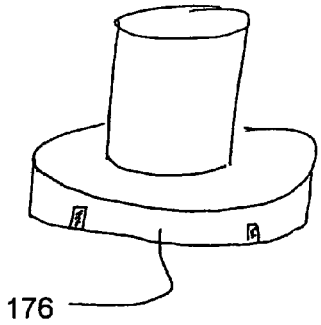
Figure 14G:
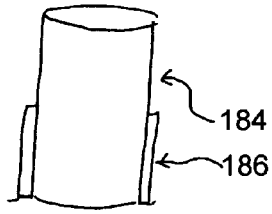

A fifth embodiment of the present invention will now be described with reference to FIG. 13 and FIGS. 14A-G which shows the separate components that are shown in their assembled position in FIG. 13.

This fifth embodiment differs from the earlier embodiments primarily in that it has a different design for the inertial noise suppression system indicated at 38*d*. There will first be a description of the main components of the inertial noise suppressing section 38*d*, after which a more detailed description of these several components.

In this inertial noise suppression section 38*d*, there is a mass 160 which is moved by a drive section 162 which comprises a magnet section 164 and a voice coil section 166. The voice coil section 166 is fixedly attached to the mass 160 and moves back and forth with the mass 160, while the magnet section 164 is connected to stationary structure. There is a suspension system 168 to which the mass 160 and the voice coil section 166 are attached. Finally, there is a support structure 170 for the forward part of inertial noise suppressing section 38*d*.

To describe each of these sections in detail, reference will continue to be made to FIG. 13, but also will be made to the various components as they are shown in FIGS. 14 A though G.

To begin first with the mass 160, this is made up of two pieces which are fixedly joined to one another. There is first an outer steel ring 172 and an inner cylindrical mass member 174 which could be made of, for example, steel or lead. These are made into separate sections primarily for ease of manufacture and assembly.

This magnet section 164 is in this embodiment of conventional design, so it will be discussed rather briefly in the comments below.

The magnet section 164 comprises three parts, namely a steel T yolk 176, a magnet 178, and the top steel gap plate 180. This magnet section 164 is substantially the same as many magnet sections that are used in present day speakers. The steel T yolk 176 provides a lower disk like base section which is attached by suitable fasteners to the back wall of the housing for the speaker section. It has a central cylindrical upstanding portion. The magnet 178 is positioned on the lower disk like portion of the steel gap plate 180 and extends upwardly therefrom. Then there is the top steel gap plate 180 which functions in conjunction with the upper part of the steel T yolk 176 to provide the gap at 182.

The voice coil section 166 also may be of conventional design, and this comprises a cylindrical voice coil former 184 which has cylindrical configuration, and the voice coil 186 which is wound thereon. With the voice coil section 166 in its neutral position, the voice coil 186 is centered in the gap 182. The upper end of the voice coil former 186 is fixedly attached to the inertial mass 160.

The suspension section 168 comprises a forward suspension 190 and a rear suspension 192. The forward suspension 196 extends outwardly from the support structure 170 and joins to a forward end portion of the inertial mass 160. This should be made with a relatively high stiffness. The rear suspension 192 extends between the support structure 170 and joins to the forward end of the voice coil former 184. These two suspensions 190 and 192 maintain the voice coil section 166 and the mass 160 in a central position so that these move reliably along a forward to rear longitudinal axis without any substantial deviation.

These two suspensions 190 and 192 perform functions which are the equivalent of those functions which are provided by surround 58 and the spider which is located at or near the housing 168 of each of the speakers 42.

Finally, we arrive at the discussion of the support structure 170. The support structure 170 has a rear mounting portion 194 which is fixedly connected to the forward steel gap plate 180 of them magnet section 164. This support structure 170 has an overall circular configuration the diameter of which expands in a forward direction from the rear mounting portion 194. At the upper end of the support structure 170 there is a radially inwardly extending flange 196 which joins to the outer perimeter portion of the forward suspension 190.

Then in a further rearward location on the support structure 170 there is a rear radially inwardly extending flange 198 which joins to an outer edge portion of the rear suspension 192.

An examination of the inertial noise suppressing section 38*d* reveal that its overall configuration is substantially the same (or nearly the same) as the configuration of the prior art speaker 42 that is described in the descriptive portion of the first embodiment.

The inertial mass 160 would generate substantially the same inertial forces as the combined inertial forces of the two speakers 42. The forward and rearward suspensions 190 and 192 serve essentially the same function as the surround 58 and the rear suspension of the speaker 42 (which is a conventional spider and therefore was not described in any detail in this text). The voice coil section 166 and the magnet section 164 are of conventional design and would be similar to a conventional speaker 42 of the first embodiment. Thus, with the same amplified electrical signal coming to the speakers 42 and also to this inertial noise suppression section 38*d*, the amplitude and frequency of the back and forth movement of the inertial mass 160 would track closely with the movements of the diaphragm sections of the two speakers 42. Present analysis would indicate that this enables the inertial mass section 38*d* to provide rather close in matching the inertial forces of the inertial noise suppressing section with those of the speaker or speakers 42 in a wide variety of operating conditions.

Various modifications can be made without departing from the basic teachings of the present invention.

I claim:

1. A speaker assembly which is adapted to be mounted to a wall structure and arranged to operate in a manner to diminish unwanted noise that can result from vibratory motion of the wall structure to which it is mounted, said speaker assembly comprising:

a speaker section comprising at least one speaker that in turn comprises a diaphragm, section that moves with a back and forth motion to create back and forth speaker inertial forces; and an inertial noise suppression section comprising an inertial mass which is movable in an arcuate manner to generate off-setting inertial forces to diminish and/or substantially off-set said speaker inertial forces that would otherwise create a noise producing vibratory motion of the wall structure to which the speaker assembly is mounted, wherein the speaker assembly has an input drive connection by which an amplified electric signal may be transmitted to the speaker of the speaker section, and the amplified electric signal is at the same time directed to a drive section of the inertial noise suppression section, so that the inertial mass is moved synchronously with the movement of the diaphragm section.

2. The speaker assembly as recited in claim 1, wherein the speaker assembly further comprises a speaker assembly structure into which the inertial forces generated by the speaker section and the inertial noise suppressing section are transmitted.

3. The speaker assembly as recited in claim 2, wherein the speaker section and the inertial noise suppressing section are both positioned within said speaker assembly structure.

4. The speaker assembly as recited in claim 3, wherein said speaker section comprises at least two speakers and the inertial noise suppressing section is located between the two speakers.

5. The speaker assembly as recited in claim 4, wherein said speaker assembly structure comprises at least a front wall, and each of said speakers has a surround connected between its related diaphragm and said front wall to transmit inertial forces generated by said diaphragm, at least partially into said front wall.

6. The speaker assembly as recited in claim 5, wherein said inertial noise suppressing section comprises an inertial support structure, with said drive section of said inertial noise suppressing section driving the inertial mass in its arcuate motion relative to said inertial support structure, said inertial support structure further transmitting said inertial forces into said speaker assembly structure.

7. The speaker assembly as recited in claim 4, wherein the speaker assembly structure comprises at least forward and rear walls and side walls, with said speaker assembly structure being a rigid structure to receive the inertial forces from both the speaker section and the inertial noise suppression section, said two speakers and said inertial noise suppression section being positioned between the two side walls and in a line generally parallel with the side walls.

8. The speaker assembly as recited in claim 7, wherein said inertial noise suppressing section is supported by a frame interconnecting said inertial noise suppressing section with said two side walls.

9. The speaker assembly as recited in claim 1, wherein the drive section comprises an adjustable power input to adjust power input to the drive section so that the inertial forces of the inertial noise suppressing section match the inertial forces generated by the speaker section.

10. The speaker assembly as recited in claim 1, wherein the inertial noise suppressing section comprises a motor section to drive the inertial mass.

11. The speaker assembly as recited in claim 1, wherein said drive section of said inertial noise suppressing section comprises a coil section and a magnet section which function relative to one another to create the inertial forces.

12. The speaker assembly as recited in claim 11, wherein said magnet section comprises at least a portion of the inertial mass of the inertial noise suppression section.

13. A speaker assembly that is adapted to be mounted to a wall structure and arranged to operate in a manner to diminish unwanted noise that can result from vibratory motion of the wall structure to which it is mounted, said speaker assembly comprising:

a speaker section comprising at least one speaker that in turn comprises a diaphragm section that moves with a back and forth motion to create back and forth speaker inertial forces; and an inertial noise suppression section comprising an inertial mass that is movable in an arcuate manner to generate off-setting inertial forces to diminish and/or substantially off-set said speaker inertial forces that would otherwise create a noise producing vibratory motion of the wall structure to which the speaker assembly is mounted, wherein:

said speaker comprises a speaker magnet and coil drive section which comprises a stationary magnet section and a coil section which connects to and, drives said diaphragm section to drive the diaphragm section in its back and forth motion, said coil section and said diaphragm section being supported by front and rear suspensions, said inertial noise suppressing system comprising an inertial magnet and coil drive section which comprises a stationary magnet section and a coil section which is connected to the mass of the inertial noise suppressing system to drive said mass in its back and forth motion, said inertial mass being supported by front and rear suspensions, said speaker having an input drive connection by which an amplified electric signal may be transmitted to said speaker, and said amplified signal is at the same time directed to the drive section of the inertial noise suppressing section so that the inertial mass of the inertial noise suppressing section is moved synchronously with the movement of the diaphragm section, and said front and rear suspensions of the inertial noise suppressing section being functional equivalents of the front and rear suspensions of the speaker to cause the movement of the mass of the inertial noise suppressing system to effectively track the movement of the diaphragm section of the speaker.

14. A method of diminishing unwanted noise in a speaker assembly which is adapted to be mounted to a wall structure and arranged to operate in a manner to diminish unwanted noise that can result from vibratory motion of the wall structure to which it is mounted, said speaker assembly comprising:

providing a speaker section comprising at least one speaker that in turn comprises a diaphragm section that moves with a back and forth motion to create back and forth speaker inertial forces;

providing an inertial noise suppression section comprising an inertial mass which is movable in an arcuate manner to generate off-setting inertial forces to diminish and/or substantially off-set said speaker inertial forces that would otherwise create a noise producing vibratory motion of the wall structure to which the speaker assembly is mounted;

providing a speaker assembly by positioning said speaker section and said inertial noise suppressing section in a speaker assembly structure so as to be connected to said speaker assembly, said speaker assembly having an input drive connection;

the inertial forces generated by the speaker section and the inertial noise suppressing section are reacted into said speaker assembly structure as offsetting inertial forces to diminish noise generating effects of said inertial forces; and transmitting an amplified electric signal to the input drive connection and to the speaker of said speaker section, and at the same time directing said amplified signal to a power section of said inertial noise suppression section, so that the inertial mass is moved synchronously with the movement of the diaphragm section.

15. The method as recited in claim 14, wherein said speaker section is provided as two speakers, said method further comprising positioning said two speakers so that these are positioned on opposite sides of said inertial noise suppressing section, in a manner that the inertial forces generated by said inertial noise suppressing section are opposite and off-setting to the inertial forces generated by said two speakers.

16. A method of diminishing unwanted noise in a speaker assembly which is adapted to be mounted to a wall structure and arranged to operate in a manner to diminish unwanted noise that can result from vibratory motion of the wall structure to which it is mounted, said speaker assembly comprising:

providing a speaker section comprising at least one speaker that in turn comprises a diaphragm section that moves with a back and forth motion to create back and forth speaker inertial forces;

providing an inertial noise suppression section comprising an inertial mass which is movable in an arcuate manner to generate off-setting inertial forces to diminish and/or substantially off-set said speaker inertial forces that would otherwise create a noise producing vibratory motion of the wall structure to which the speaker assembly is mounted;

providing a speaker assembly by positioning said speaker section and said inertial noise suppressing section in a speaker assembly structure so as to be connected to said speaker assembly;

the inertial forces generated by the speaker section and the inertial noise suppressing section are reacted into said speaker assembly structure as offsetting inertial forces to diminish noise generating effects of said inertial forces, wherein, said speaker is provided with a speaker drive section which comprises a stationary magnet section and a coil section which connects to said diaphragm section to drive the diaphragm section in its back and forth motion, said coil section with said diaphragm section being supported by front and rear suspensions, said inertial noise suppressing section being provided with an inertial magnet and coil drive section which comprises a stationary magnet section and a coil section which is connected to the inertial mass of the inertial noise suppressing system, said method comprising supporting said inertial mass with said coil section by front and rear suspensions, said speaker being provided with an input drive connection by which an amplified electric signal may be transmitted to said speaker, with said amplified signal at the same time being directed to the drive section of the inertial noise suppressing section so that the inertial mass of the inertial noise suppressing section is moved synchronously with the movement of the diaphragm section, and said method further comprising providing said front and rear suspensions of the inertial noise suppressing section as functional equivalents of the front and rear suspensions of the speaker to cause the movement of the mass of the inertial noise suppressing system to effectively track the movement of the diaphragm section of the speaker.

* * * * *